US006059048A

United States Patent [19]

Subrt

[11] Patent Number: 6,059,048

[45] Date of Patent: May 9, 2000

[54] IMPLEMENT MOUNTING ARRANGEMENT WITH INDEPENDENT LIFT-ROLL AND PITCH-YAW OPERABILITY

[75] Inventor: Michael C. Subrt, Peoria, Ill.

[73] Assignee: Caterpillar Inc., Peoria, Ill.

[21] Appl. No.: 09/244,378

[22] Filed: Feb. 4, 1999

[51] Int. Cl.[7] ..... E02F 3/76

[52] U.S. Cl. ..... 172/821; 172/810

[58] Field of Search ..... 172/810, 811, 172/812, 818, 819, 820, 821, 822, 823, 824, 825, 826, 827; 37/235, 236, 282, 283

[56] References Cited

U.S. PATENT DOCUMENTS

| | | | |
|---|---|---|---|
| 3,653,451 | 4/1972 | Fryrear et al. | 172/804 |
| 3,913,684 | 10/1975 | Casey et al. | 172/804 |
| 4,270,617 | 6/1981 | Cantarella et al. | 172/821 |
| 4,405,019 | 9/1983 | Frisbee | 172/816 |
| 4,463,507 | 8/1984 | Gaub | 37/117.5 |
| 4,848,483 | 7/1989 | Heiple | 172/821 |
| 4,893,683 | 1/1990 | Horsch et al. | 172/821 |
| 4,976,054 | 12/1990 | Jones | 37/235 |
| 5,010,961 | 4/1991 | Frisbee | 172/821 |
| 5,447,204 | 9/1995 | Asal et al. | 172/821 |
| 5,477,600 | 12/1995 | Houle et al. | 37/279 |
| 5,620,053 | 4/1997 | Kamikawa et al. | 172/812 X |
| 5,799,737 | 9/1998 | Kamikawa et al. | 172/821 X |

*Primary Examiner*—Robert E. Pezzuto
*Attorney, Agent, or Firm*—Haverstock, Garrett and Roberts

[57] ABSTRACT

An implement mounting arrangement for a work machine providing simplified, independent lift-roll and pitch-yaw operability. The present arrangement includes at least one push arm connected to the work machine for rotation about a horizontal lift axis; an implement support frame mounted to the at least one push arm for rotation about a roll axis and including a lift arm extending cross-wise to the roll axis, the lift arm including a first terminal end and an opposite second terminal end located respectively on opposite sides of the roll axis in spaced relation thereto; an implement mounted to the implement support frame for rotation about a pitch axis and about a yaw axis; a pair of lift-roll cylinders operably connected between the work machine and the respective terminal ends of the lift arm; and a pair of pitch-yaw cylinders operably connected between the implement and the respective terminal ends of the lift arm; wherein the lift-roll cylinders are operable to rotate the support frame and the implement about the lift axis and about the roll axis relative to the work machine independently of the pitch-yaw cylinders, and the pitch-yaw cylinders are operable to rotate the implement about the pitch axis and about the yaw axis relative to the implement support frame independently of the lift-roll cylinders.

7 Claims, 2 Drawing Sheets

IMPLEMENT MOUNTING ARRANGEMENT WITH INDEPENDENT LIFT-ROLL AND PITCH-YAW OPERABILITY

TECHNICAL FIELD

This invention relates generally to arrangements for mounting implements such as blades and the like on work machines such as bulldozers, crawlers, tractors and the like, and in particular to an implement mounting arrangement with independent lift-roll and pitch-yaw operability.

BACKGROUND ART

Currently, known implement mounting arrangements which provide "all-way" operability, that is, the ability to move independently about axes for lift, roll, pitch and yaw, suffer from shortcomings including requiring complex operating software for the cylinders controlling the movement of the implement, and interference between the operability of the respective cylinders for some compound movements about multiple axis.

Accordingly, the present invention is directed to overcoming one or more of the problems as set forth above.

DISCLOSURE OF THE INVENTION

In one aspect of the present invention an implement mounting arrangement for a work machine which provides simplified, independent lift-roll and pitch-yaw operability is disclosed. The present arrangement includes at least one push arm having a first end connected to the work machine for rotation about a horizontal lift axis and an opposite second end;

an implement support frame having a push arm end mounted to the second end of the at least one push arm for rotation about a roll axis, the implement support frame having an implement end opposite the push arm end, the roll axis extending through the implement support frame between the push arm end and the implement end, and the implement support frame including a lift arm extending cross-wise to the roll axis and including a first terminal end and an opposite second terminal end located respectively on opposite sides of the roll axis in spaced relation thereto;

an implement mounted to the implement end of the implement support frame for rotation about a pitch axis and about a yaw axis;

a pair of lift-roll cylinders operably connected between the work machine and the respective terminal ends of the lift arm; and a pair of pitch-yaw cylinders operably connected between the implement and the respective terminal ends of the lift arm;

wherein the lift-roll cylinders are operable to rotate the support frame and the implement about the lift axis and about the roll axis relative to the work machine independently of the pitch-yaw cylinders, and the pitch-yaw cylinders are operable to rotate the implement about the pitch axis and about the yaw axis relative to the implement support frame independently of the lift-roll cylinders.

BEST MODE FOR CARRYING OUT THE INVENTION

Figure 1:
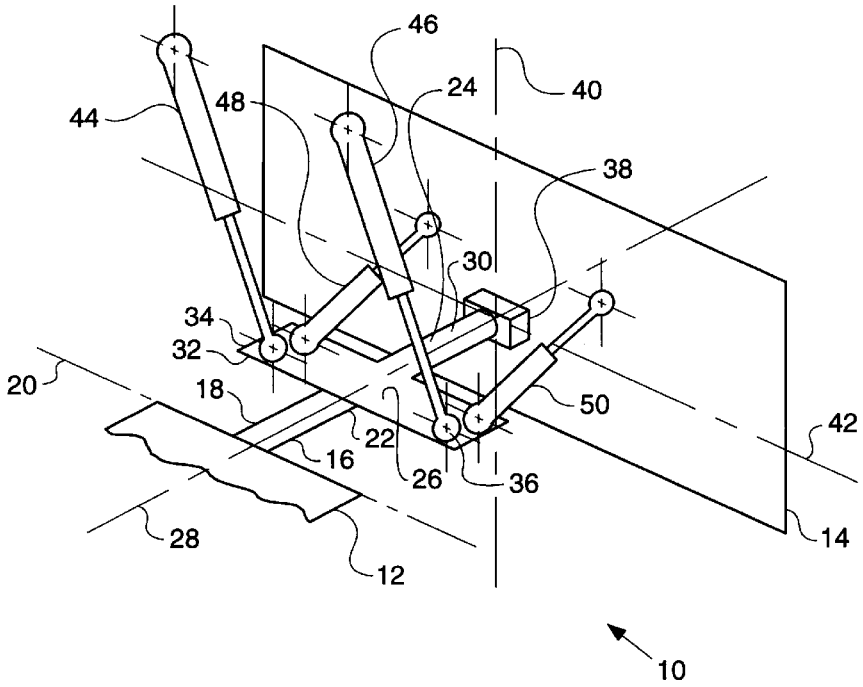
FIG. 1 is a schematic perspective view of an implement mounting arrangement according to the present invention.

Referring now to the drawings, FIG. 1 illustrates an implement mounting arrangement 10 constructed and operable according to the teachings of the present invention. Arrangement 10 is shown installed on a work machine 12 representative of a wide variety of different machines such as bulldozers, excavators, loaders, graders and the like. Implement mounting arrangement is shown in association with an implement 14 representative of a wide variety of implements utilized with the aforementioned work machines including, but not limited to, a blade used for earthmoving, snow removal and like purposes, a scoop or a bucket, all of conventional construction and operation.

Figure 2:
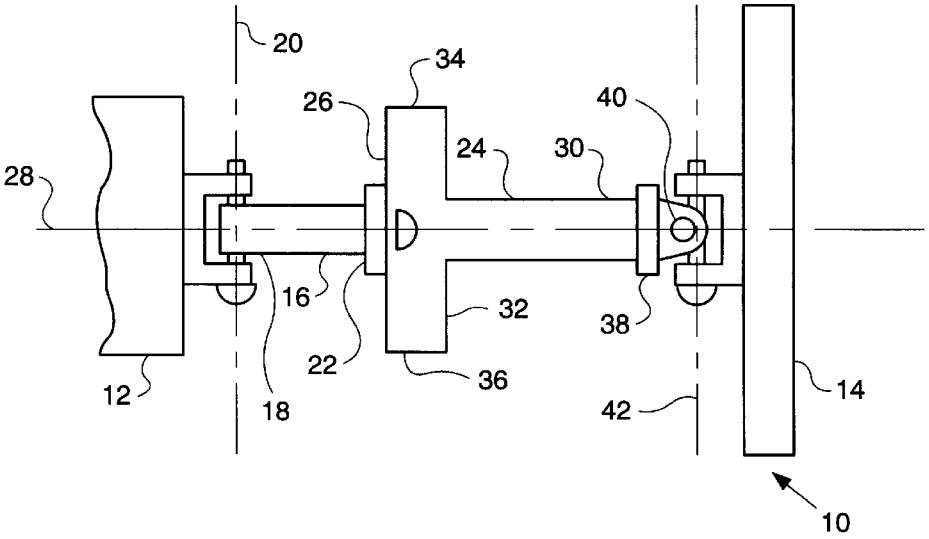
FIG. 2 is a schematic top view of the mounting arrangement of FIG. 1.

Referring also to FIG. 2, arrangement 10 includes a push arm 16 having a first end 18 connected by a conventional pinned connection to work machine 12 for rotation about a horizontal lift axis 20, and an opposite second end 22. An implement support frame 24 has a push arm end 26 mounted to second end 22 of push arm 16 using a conventional pinned connection for rotation about a roll axis 28. Implement support frame 24 has an implement end 30 opposite push arm end 26, roll axis 28 extending through implement support frame 24 between push arm end 26 and implement end 30.

Implement support frame 24 includes a lift arm portion 32 extending cross-wise to roll axis 28 at about a right angle, lift arm portion 32 including a first terminal end 34 on one side of roll axis 28 in spaced relation thereto, and an opposite second terminal end 36 on the opposite side of the roll axis spaced therefrom.

Implement 14 is mounted to implement end 30 of implement support frame 24 with a conventional universal joint 38 for rotation about a pitch axis 42 and about a yaw axis 40.

A pair of lift-roll cylinders 44 and 46 are operatively connected between work machine 12 and respective terminal ends 34 and 36 of lift arm portion 32 of the implement support frame 24 at conventional pivotal connections. A pair of pitch-yaw cylinders 48 and 50 are operatively connected between the respective terminal ends 34 and 36 of implement support frame 24 and implement 14 with conventional pivotal connections. Each of cylinders 44, 46, 48, and 50 is of conventional construction and operation in connection with a suitable hydraulic system on work machine 12 (not shown) for retracting and extending under command of an operator located in an operator cab of machine 12 (also not shown) according to well known hydraulic principles.

In operation, lift-roll cylinders 44 and 46 are simultaneously operable in a retract mode to pivot or rotate push arm 16, implement support frame 24 and implement 14 for lifting the implement, and are simultaneously operable in an extend mode to lower implement 14, independently of operation of pitch-yaw cylinders 48 and 50. Lift-roll cylinders 44 and 46 are also operable independently of pitch-yaw cylinders 48 and 50 in opposite directions to rotate implement support frame 24 and implement 14 about roll axis 28. Similarly, pitch-yaw cylinders 48 and 50 are simultaneously operable independently of lift-roll cylinders 44 and 46 in an extend mode to rotate implement 14 clockwise about pitch axis 42, and in a retract direction to rotate implement 14 counter clockwise about the pitch axis. Pitch-yaw cylinders 48 and 50 are operable in opposite directions to rotate implement 14 about yaw axis 40.

Figure 3:
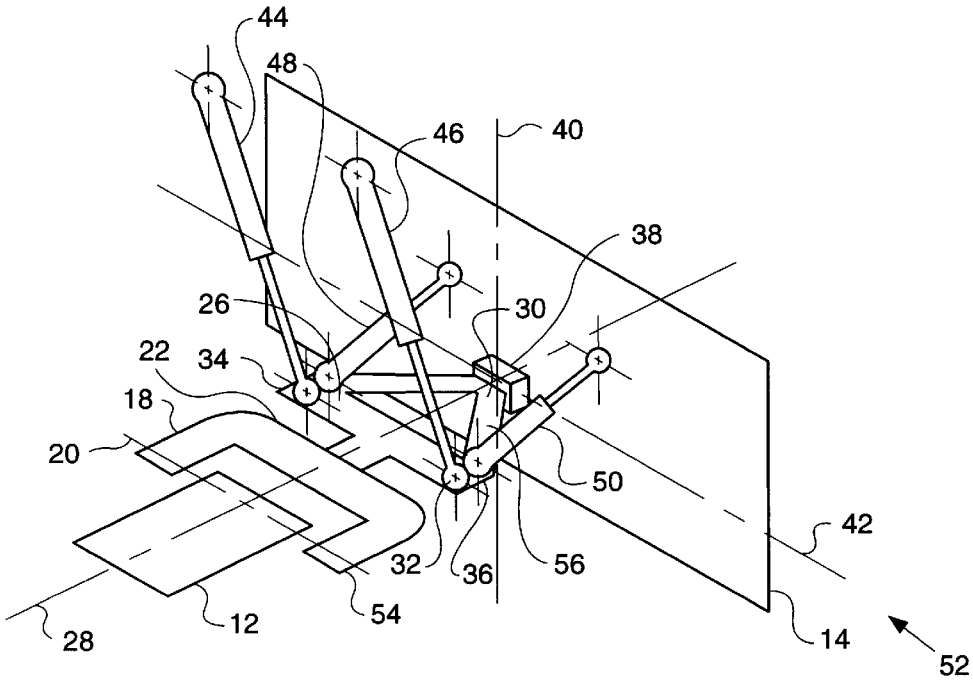
FIG. 3 is a schematic perspective view of another mounting arrangement according to the present invention.
Figure 4:
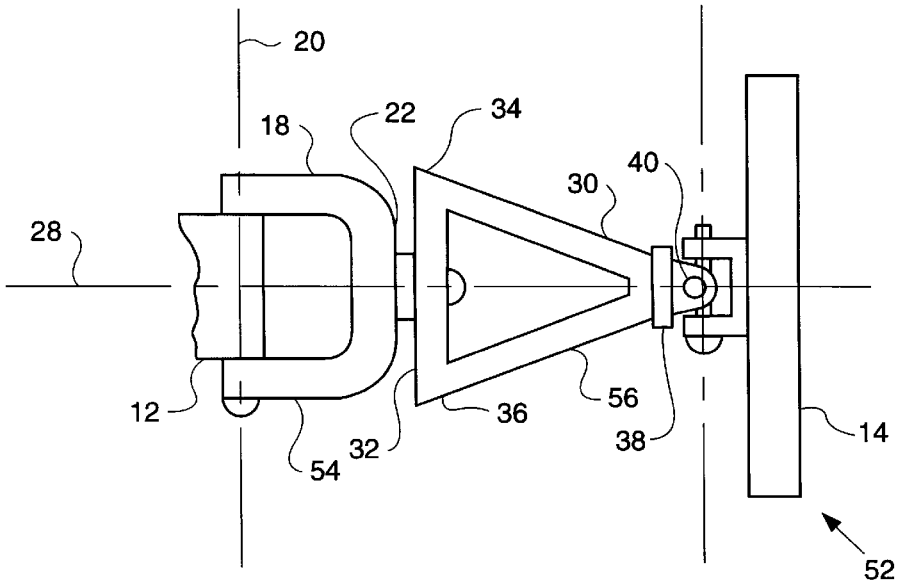
FIG. 4 is a schematic top view of the mounting arrangement of FIG. 3.

Turning to FIGS. 3 and 4, an alternative embodiment 52 of an implement mounting arrangement according to the present invention is shown. Arrangement 52 includes a C-shape push arm 54 having a first end 18 conventionally mounted for rotation to work machine 12 about a lift axis 20, and an opposite second end 22.

An implement support frame 56 has a push arm end 26 mounted to second end 22 of push arm 54 at a conventional pinned connection for rotation about a roll axis 28. Implement support frame 56 has an implement end 30 opposite push rod end 26, roll axis 28 extending through implement support frame 56 between push arm end 26 and implement end 30. Implement support frame 56 includes a lift arm portion 32 extending cross-wise to roll axis 28 at about a right angle, lift arm portion 32 including a first terminal end 34 on one side of roll axis 28 in spaced relation thereto and an opposite second terminal end 36 on the opposite side of the roll axis spaced therefrom. Implement 14 is mounted to implement end 30 of implement support frame 56 with a conventional universal joint 38 for rotation about a pitch axis 42 and about a yaw axis 40.

Again, a pair of lift-roll cylinders 44 and 46 are operatively connected between work machine 12 and respective terminal ends 34 and 36 of lift arm portion 32 of the implement support frame 56 at conventional pivotal connections. A pair of pitch-yaw cylinders 48 and 50 are operatively connected between the respective terminal ends 34 and 36 of implement support frame 56 and implement 14 with conventional pivotal connections. Each of cylinders 44, 46, 48, and 50 is of conventional construction and operation in connection with a suitable hydraulic system on work machine 12 (not shown) for retracting and extending under command of an operator located in an operator cab of machine 12 (also not shown) according to well known hydraulic principles.

In operation, lift-roll cylinders 44 and 46 are simultaneously operable in a retract mode to pivot or rotate push arm 54, implement support frame 56 and implement 14 for lifting the implement, and are simultaneously operable in an extend mode to lower implement 14, independently of pitch-yaw cylinders 48 and 50. Likewise, lift-roll cylinders 44 and 46 are operable independently of pitch-yaw cylinders 48 and 50 in opposite directions to rotate implement support frame 56 and implement 14 about roll axis 28. Similarly, pitch-yaw cylinders 48 and 50 are simultaneously operable in an extend mode to rotate implement 14 clockwise about pitch axis 42 independently of cylinders 44 and 46, and in a retract direction to rotate implement 14 counter clockwise about the pitch axis. Pitch-yaw cylinders 48 and 50 are operable in opposite directions to rotate implement 14 about yaw axis 40.

INDUSTRIAL APPLICABILITY

The implement mounting arrangement with independent lift-roll and pitch-yaw operability of the present invention has utility for a wide variety of work machines wherein improved freedom and simplification of movement of an implement thereof is desired.

Other aspects, objects and advantages of the present invention can be obtained from a study of the drawings, the disclosure and the appended claims.

What is claimed is:

1. An implement mounting arrangement for a work machine, comprising:

at least one push arm having a first end connected to the work machine for rotation about a horizontal lift axis and an opposite second end;

an implement support frame having a push arm end mounted to the second end of the at least one push arm for rotation about a roll axis, the implement support frame having an implement end opposite the push arm end, the roll axis extending through the implement support frame between the push arm end and the implement end, and the implement support frame including a lift arm extending cross-wise to the roll axis and including a first terminal end and an opposite second terminal end located respectively on opposite sides of the roll axis in spaced relation thereto;

an implement mounted to the implement end of the implement support frame for rotation about a pitch axis and about a yaw axis;

a pair of lift-roll cylinders operably connected between the work machine and the respective terminal ends of the lift arm; and a pair of pitch-yaw cylinders operably connected between the implement and the respective terminal ends of the lift arm.

2. The implement mounting arrangement, as set forth in claim 1, wherein the implement support frame is a T-shaped member.

3. The implement mounting arrangement, as set forth in claim 1, wherein the implement support frame is a triangular shaped member.

4. The implement mounting arrangement, as set forth in claim 1, comprising a single push arm having an axis therethrough coincident with the roll axis.

5. The implement mounting arrangement, as set forth in claim 1, wherein the push arm is a C-shaped member.

6. The implement mounting arrangement, as set forth in claim 1, wherein the implement comprises a blade.

7. The implement mounting arrangement, as set forth in claim 1, wherein the implement is mounted to the implement end of the implement support frame with a universal joint allowing independent rotation of the implement about the pitch axis and the yaw axis.

* * * * *